US009127836B2

(12) United States Patent
Matsumoto et al.

(10) Patent No.: US 9,127,836 B2
(45) Date of Patent: Sep. 8, 2015

(54) COMBUSTION BURNER AND BOILER INCLUDING THE SAME

(75) Inventors: Keigo Matsumoto, Tokyo (JP); Koutaro Fujimura, Tokyo (JP); Kazuhiro Domoto, Tokyo (JP); Toshimitsu Ichinose, Tokyo (JP); Naofumi Abe, Tokyo (JP); Jun Kasai, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 13/388,213

(22) PCT Filed: Mar. 11, 2010

(86) PCT No.: PCT/JP2010/054091

§ 371 (c)(1),
(2), (4) Date: Mar. 23, 2012

(87) PCT Pub. No.: WO2011/077762

PCT Pub. Date: Jun. 30, 2011

(65) Prior Publication Data

US 2012/0247376 A1 Oct. 4, 2012

(30) Foreign Application Priority Data

Dec. 22, 2009 (JP) ..... 2009-290899
Feb. 9, 2010 (JP) ..... 2010-026882

(51) Int. Cl.
*F23D 1/00* (2006.01)
*F23C 6/04* (2006.01)

(52) U.S. Cl.
CPC . *F23D 1/00* (2013.01); *F23C 6/045* (2013.01); *F23C 2201/20* (2013.01); *F23D 2201/10* (2013.01); *F23D 2201/20* (2013.01); *F23D 2209/20* (2013.01)

(58) Field of Classification Search
CPC ..... F23D 2201/10; F23D 2201/101; F23D 2201/20; F23D 1/00; F23D 1/04; F23D 1/06; F23D 14/045; F23D 14/26; F23D 14/74; F23D 14/84; F23D 2209/20; F23D 11/406
USPC ..... 110/104 B; 431/350, 354
See application file for complete search history.

(56) References Cited

U.S. PATENT DOCUMENTS 4,428,727 A * 1/1984 Deussner et al. ..... 110/263
4,614,159 A * 9/1986 Sugiura et al. ..... 110/261

(Continued)

FOREIGN PATENT DOCUMENTS

CN 1199453 A 11/1998
CN 1271826 A 11/2000

(Continued)

OTHER PUBLICATIONS

International Search Report of PCT/JP2010/054091, date of mailing Apr. 27, 2010.

(Continued)

*Primary Examiner* — David J Laux
(74) *Attorney, Agent, or Firm* — Westerman, Hattori, Daniels & Adrian, LLP

(57) ABSTRACT

A combustion burner 1 includes a fuel nozzle 2 that injects fuel gas prepared by mixing solid fuel and primary air, secondary air nozzles 3, 4 that inject secondary air from the outer periphery of the fuel nozzle 2, and a flame holder 5 that is arranged in an opening of the fuel nozzle 2. In the combustion burner 1, the flame holder 5 has a splitting shape that widens in the flow direction of the fuel gas. When seen in cross section along a direction in which the flame holder 5 widens, the cross section passing through the central axis of the fuel nozzle 2, a maximum distance h from the central axis of the fuel nozzle 2 to the widened end of the flame holder 5 and an inside diameter r of the opening 21 of the fuel nozzle 2 satisfy h/(r/2)<0.6.

18 Claims, 13 Drawing Sheets

(56) References Cited

U.S. PATENT DOCUMENTS

| | | | | | |
|---|---|---|---|---|---|
| 4,634,054 | A * | 1/1987 | Grusha | 239/423 |
| 4,988,286 | A * | 1/1991 | Hersh | 431/8 |
| 5,263,426 | A * | 11/1993 | Morita et al. | 110/265 |
| 5,979,342 | A * | 11/1999 | Leisse et al. | 110/264 |
| 6,978,726 | B2 * | 12/2005 | Kobayashi et al. | 110/347 |
| 2007/0234938 | A1 | 10/2007 | Briggs, Jr. et al. | |
| 2008/0206696 | A1 * | 8/2008 | Wark | 431/202 |
| 2009/0277364 | A1 * | 11/2009 | Donais et al. | 110/263 |

FOREIGN PATENT DOCUMENTS

| | | | | |
|---|---|---|---|---|
| CN | 1386180 | A | 12/2002 | |
| CN | 1246627 | C | 3/2006 | |
| EP | 0 687 857 | A2 | 12/1995 | |
| JP | 46-3549 | | 1/1971 | |
| JP | 60-78208 | A | 5/1985 | |
| JP | 60-162108 | A | 8/1985 | |
| JP | 60-171307 | A | 9/1985 | |
| JP | 62-000909 | U | 1/1987 | |
| JP | 62-288406 | A | 12/1987 | |
| JP | 1-74409 | U | 5/1989 | |
| JP | 1-217109 | A | 8/1989 | |
| JP | 02-25086 | A | 1/1990 | |
| JP | 02-25086 | B2 | 5/1990 | |
| JP | 2-29368 | Y2 | 8/1990 | |
| JP | 4-115208 | U | 10/1992 | |
| JP | 7-260106 | A | 10/1995 | |
| JP | 08-135919 | A | 5/1996 | |
| JP | 8-219415 | A | 8/1996 | |
| JP | 08-296815 | A | 11/1996 | |
| JP | 09-101006 | A | 4/1997 | |
| JP | 09-203505 | A | 8/1997 | |
| JP | 2749365 | B2 | 5/1998 | |
| JP | 2781740 | B2 | 7/1998 | |
| JP | 2002-228107 | A | 8/2002 | |
| JP | 2002228107 | A * | 8/2002 | F23C 11/00 |
| JP | 2003-279006 | A | 10/2003 | |
| JP | 3679998 | B2 | 8/2005 | |
| JP | 3716095 | B2 | 11/2005 | |
| JP | 200907255 | A | 2/2009 | |
| TW | 313247 | | 8/1997 | |
| TW | 200951374 | A | 12/2009 | |
| WO | 2009/114331 | A2 | 9/2009 | |

OTHER PUBLICATIONS

Concise explanation of relevance for Foreign Patent Document No. JP46-3549; original document submitted in the IDS filed May 17, 2012. (1 page).

Concise explanation of relevance for Foreign Patent Document No. JP60-162108; original document submitted in the IDS filed May 17, 2012. (1 page).

Concise explanation of relevance for Foreign Patent Document No. JP60-171307; original document submitted in the IDS filed May 17, 2012. (1 page).

Concise explanation of relevance for Foreign Patent Document No. JP62-288406; original document submitted in the IDS filed May 17, 2012. (1 page).

Written Opinion of the International Searching Authority (Form PCT/IB/237) of International Application No. PCT/JP2010/054091 mailed Apr. 27, 2010.(6 pages).

Japanese Office Action dated May 21, 2013, issued in corresponding Japanese Patent Application No. 2010-026882 with English translation (8 pages).

Taiwanese Office Action dated Apr. 8, 3013, issued in corresponding Taiwanese Patent Application No. 099123189, w/ English translation.

Notice of Allowance dated Aug. 27, 2013, issued in corresponding Japanese Patent Application No. 2010-026882, w/ partial English translation.

Chinese Office Action dated Feb. 12, 2014, issued in corresponding Chinese Patent Application No. 201080018542.1, w/English translation (25 pages).

Notice of Allowance dated Jun. 23, 2014, issued in corresponding Korean Patent Application No. 10-2013-7030282, w/ partial English translation (3 pages).

Ukrainian Office Action of Ukrainian Application No. 201200836 dated Dec. 9, 2013, received Oct. 2, 2014 due to miscommunication associated with recent political and military unrest in Ukraine; with English translation (15 pages).

Extended European Search Report dated May 4, 2015, issued in corresponding European Patent Application No. 10839000.6 (6 pages).

Office Action dated Jun. 30, 2015, issued in counterpart Malaysian application No. PI 2012000294 (3 pages).

Office Action dated May 28, 2015, issued in counterpart Chinese application No. 201310540955.1, w/English translation (18 pages).

* cited by examiner $\theta < 90$ [deg]

DURING STEADY OPERATION

DURING START OPERATION

COMBUSTION BURNER AND BOILER INCLUDING THE SAME

TECHNICAL FIELD

The present invention relates to a combustion burner and a boiler including the combustion burner, and more particularly, to a combustion burner capable of reducing the emission amount of nitrogen oxides (NOx) and a boiler including the combustion burner.

BACKGROUND ART

Conventional combustion burners typically employ a configuration to stabilize the outer flame of combustion flame. In this configuration, a high-temperature and high-oxygen area is formed in an outer peripheral part of the combustion flame, resulting in an increase in the emission amount of NOx. As an example of such conventional combustion burners employing this configuration, a technology described in Patent Document 1 is known.

[Patent Document 1] Japanese Patent No. 2781740

DISCLOSURE OF INVENTION

Problem to be Solved by the Invention

The present invention has an object to provide a combustion burner capable of reducing the emission amount of NOx and a boiler including the combustion burner.

Means for Solving Problem

According to an aspect of the present invention, a combustion burner includes: a fuel nozzle that injects fuel gas prepared by mixing solid fuel and primary air; a secondary air nozzle that injects secondary air from outer periphery of the fuel nozzle; and a flame holder that is arranged in an opening of the fuel nozzle. The flame holder has a splitting shape that widens in a flow direction of the fuel gas, and when seen in cross section along a direction in which the flame holder widens, the cross section passing through a central axis of the fuel nozzle, a maximum distance h from the central axis of the fuel nozzle to a widened end of the flame holder and an inside diameter r of the opening of the fuel nozzle satisfy $h/(r/2) < 0.6$.

Effect of the Invention

Because the combustion burner according to the present invention achieves inner flame stabilization of combustion flame (flame stabilization in a central area of the opening of the fuel nozzle), an outer peripheral part of the combustion flame is kept at low temperature compared with configurations for outer flame stabilization of combustion flame (flame stabilization in the outer periphery of the fuel nozzle or flame stabilization in an area near the inner wall surface of the opening of the fuel nozzle). Therefore, with the secondary air, the temperature of the outer peripheral part of the combustion flame in a high oxygen atmosphere can be lowered. This is advantageous in that the emission amount of NOx in the outer peripheral part of the combustion flame is reduced.

BEST MODE (S) FOR CARRYING OUT THE INVENTION

The present invention will now be described in detail with reference to the accompanying drawings. This embodiment is not intended to limit the present invention. Components in the embodiment include components that are replaceable and obviously replaceable while maintaining unity of the invention. A plurality of modifications described in the embodiment can be combined in any manner within the scope obvious to those skilled in the art.

[Pulverized Coal Combustion Boiler]

Figure 22:
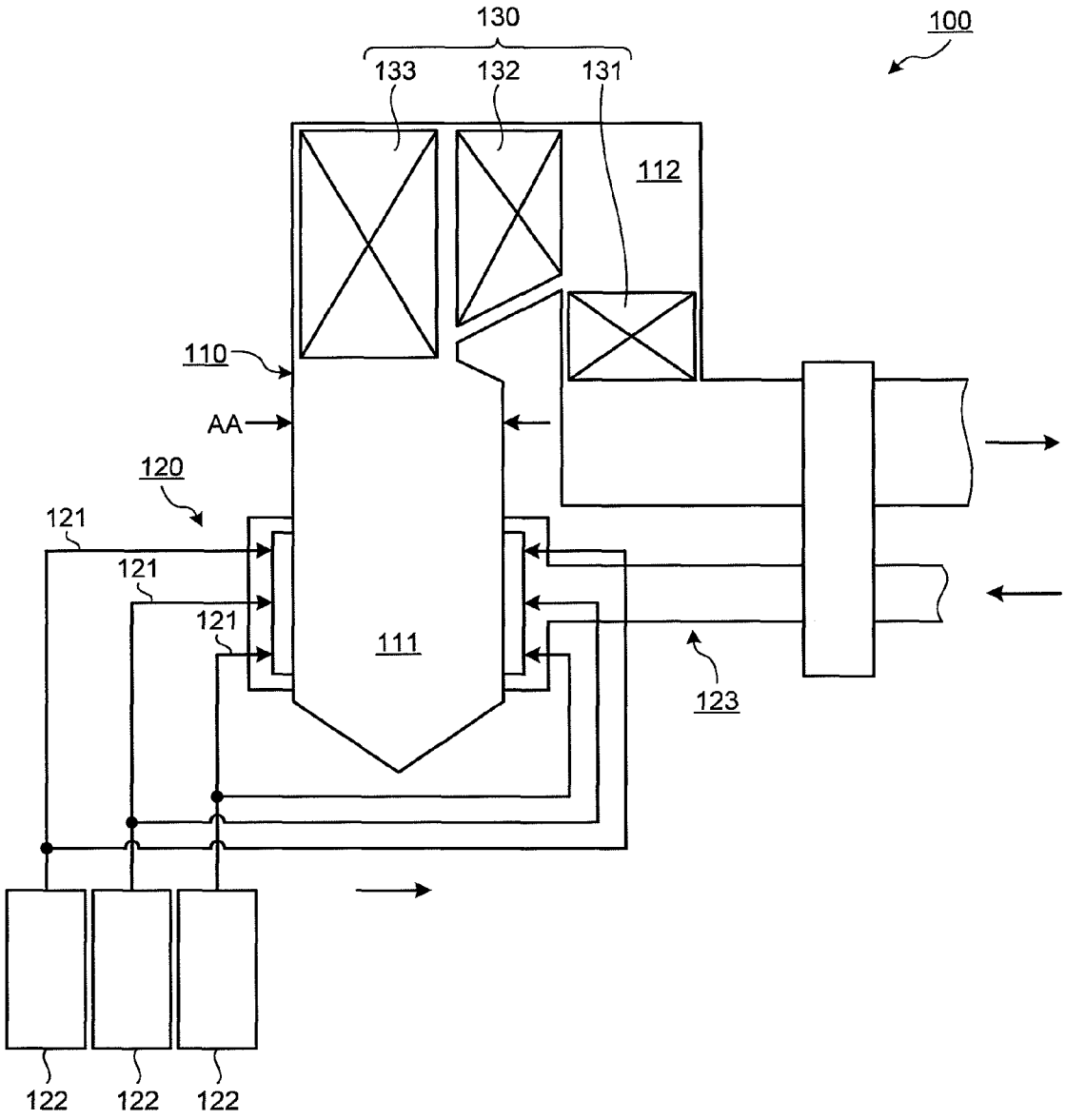
FIG. 22 is a configuration diagram of a typical pulverized coal combustion boiler.

FIG. 22 is a configuration diagram of a typical pulverized coal combustion boiler. This pulverized coal combustion boiler 100 is a boiler that burns pulverized coal to produce thermal energy and is used for power generation or industrial applications, for example.

The pulverized coal combustion boiler 100 includes a furnace 110, a combustion apparatus 120, and a steam generating apparatus 130 (see FIG. 22). The furnace 110 is a furnace for burning pulverized coal, and includes a combustion chamber 111 and a flue gas duct 112 connected above the combustion chamber 111. The combustion apparatus 120 is an apparatus that burns pulverized coal, and includes combustion burners 121, pulverized coal supply systems 122 supplying pulverized coal to the respective combustion burners 121, and an air supply system 123 supplying secondary air to the combustion burners 121. The combustion apparatus 120 is so arranged that the combustion burners 121 are connected to the combustion chamber 111 of the furnace 110. In the combustion apparatus 120, the air supply system 123 supplies additional air for completing oxidation and combustion of pulverized coal to the combustion chamber 111. The steam generating apparatus 130 is an apparatus that heats water fed to the boiler through heat exchange with fuel gas to generate steam, and includes an economizer 131, a reheater 132, a superheater 133, and a steam drum (not illustrated). The steam generating apparatus 130 is so configured that the economizer 131, the reheater 132, and the superheater 133 are arranged stepwise on the flue gas duct 112 of the furnace 110.

In the pulverized coal combustion boiler 100, first, in the combustion apparatus 120, the pulverized coal supply system 122 supplies pulverized coal and primary air to the combustion burner 121, and the air supply system 123 supplies secondary air for combustion to the combustion burner 121 (see FIG. 22). Subsequently, the combustion burner 121 ignites fuel gas containing pulverized coal, primary air, and secondary air and injects the fuel gas into the combustion chamber 111. Consequently, the fuel gas burns in the combustion chamber 111, whereby fuel gas is produced. The fuel gas is then discharged from the combustion chamber 111 through the flue gas duct 112. In this process, the steam generating apparatus 130 causes heat exchange between the fuel gas and water fed to the boiler to generate steam. The steam is to be supplied to an external plant (a steam turbine, for example).

In the pulverized coal combustion boiler 100, the sum of the supply amount of primary air and the supply amount of secondary air is set to be less than a theoretical air volume with respect to the supply amount of pulverized coal, whereby the combustion chamber 111 is maintained at a reduction atmosphere. NOx emitted as a result of combustion of the pulverized coal is reduced in the combustion chamber 111, and additional air (AA) is additionally supplied thereafter, whereby oxidation and combustion of the pulverized coal are completed (additional-air system). Thus, the emission amount of NOx due to combustion of the pulverized coal is decreased.

[Combustion Burner]

Figure 1:
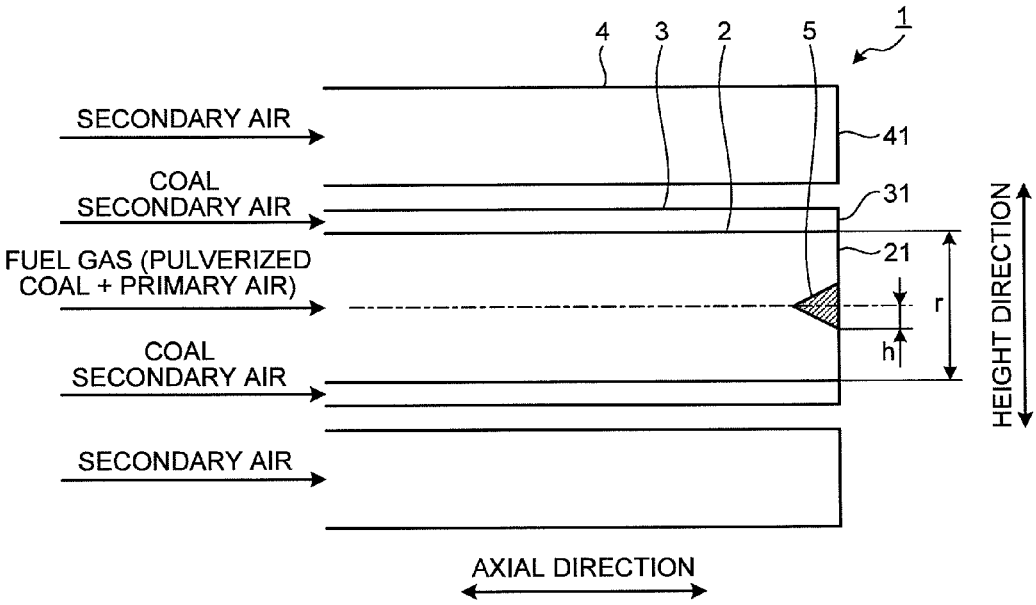
FIG. 1 is a configuration diagram of a combustion burner according to an embodiment of the present invention.
Figure 2:
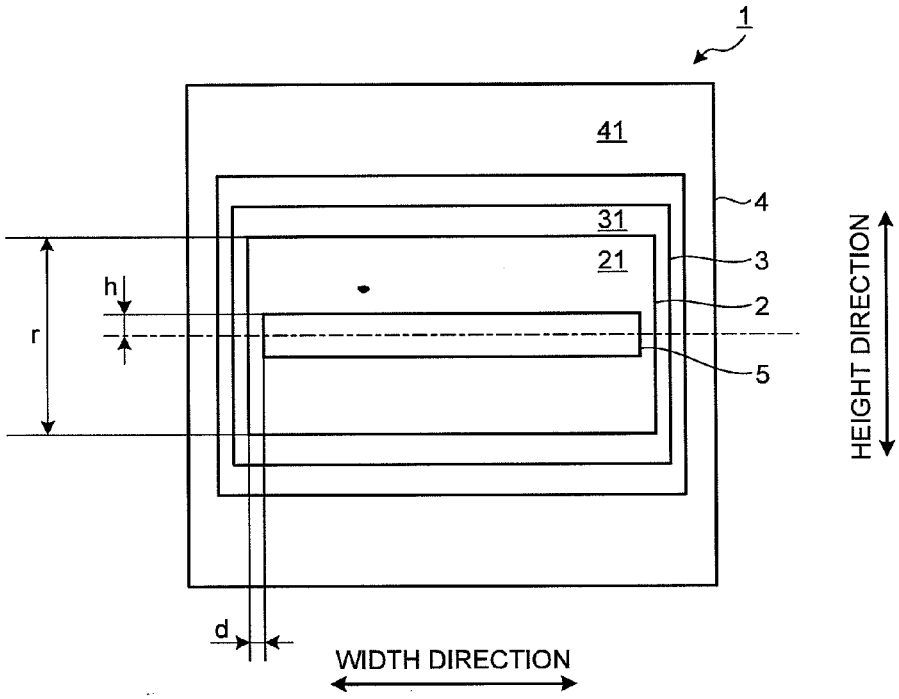
FIG. 2 is a front view of an opening of the combustion burner illustrated in FIG. 1.

FIG. 1 is a configuration diagram of a combustion burner according to an embodiment of the present invention, and is a sectional view of the combustion burner in its height direction along its central axis. FIG. 2 is a front view of an opening of the combustion burner illustrated in FIG. 1.

This combustion burner 1 is a solid fuel combustion burner for burning solid fuel, and is used as the combustion burner 121 in the pulverized coal combustion boiler 100 illustrated in FIG. 22, for example. An example will now be given in which pulverized coal is used as solid fuel, and the combustion burner 1 is applied to the pulverized coal combustion boiler 100.

The combustion burner 1 includes a fuel nozzle 2, a main secondary air nozzle 3, a secondary air nozzle 4, and a flame holder 5 (see FIGS. 1 and 2). The fuel nozzle 2 is a nozzle that injects fuel gas (primary air containing solid fuel) prepared by mixing pulverized coal (solid fuel) and primary air. The main secondary air nozzle 3 is a nozzle that injects main secondary air (coal secondary air) into the outer periphery of the fuel gas injected by the fuel nozzle 2. The secondary air nozzle 4 is a nozzle that injects secondary air into the outer periphery of the main secondary air injected by the main secondary air nozzle 3. The flame holder 5 is a device used for igniting the fuel gas and stabilizing the flame, and is arranged in an opening 21 of the fuel nozzle 2.

For example, in the present embodiment, the fuel nozzle 2 and the main secondary air nozzle 3 each have an elongated tubular structure, and have rectangular openings 21 and 31, respectively (see FIGS. 1 and 2). With the fuel nozzle 2 at the center, the main secondary air nozzle 3 is arranged on the outer side, whereby a double tube is formed. The secondary air nozzle 4 has a double-tube structure, and has a ring-shaped opening 41. In the inner ring of the secondary air nozzle 4, the fuel nozzle 2 and the main secondary air nozzle 3 are inserted and arranged. Accordingly, with the opening 21 of the fuel nozzle 2 at the center, the opening 31 of the main secondary air nozzle 3 is arranged on the outer side of the opening 21, and the opening 41 of the secondary air nozzle 4 is arranged on the outer side of the opening 31. The openings 21 to 41 of these nozzles 2 to 4 are aligned and arranged coplanarly. The flame holder 5 is supported by a plate member (not illustrated) on the upstream side of the fuel gas, and is arranged in the opening 21 of the fuel nozzle 2. The downstream end (widened end) of the flame holder 5 and the openings 21 to 41 of these nozzles 2 to 4 are aligned coplanarly.

In the combustion burner 1, the fuel gas prepared by mixing pulverized coal and primary air is injected through the opening 21 of the fuel nozzle 2 (see FIG. 1). In this process, the fuel gas is branched at the flame holder 5 in the opening 21 of the fuel nozzle 2, and then ignited and burnt to be fuel gas. To the outer periphery of the fuel gas, the main secondary air is injected through the opening 31 of the main secondary air nozzle 3, whereby the combustion of the fuel gas is facilitated. To the outer periphery of combustion flame, the secondary air is supplied through the opening 41 of the secondary air nozzle 4, whereby the outer peripheral part of the combustion flame is cooled down.

[Arrangement of Flame Holder]

In the combustion burner 1, to reduce the emission amount of NOx as a result of the combustion of pulverized coal, the arrangement of the flame holder 5 relative to the opening 21 of the fuel nozzle 2 is optimized, which will be described below.

Figure 3:
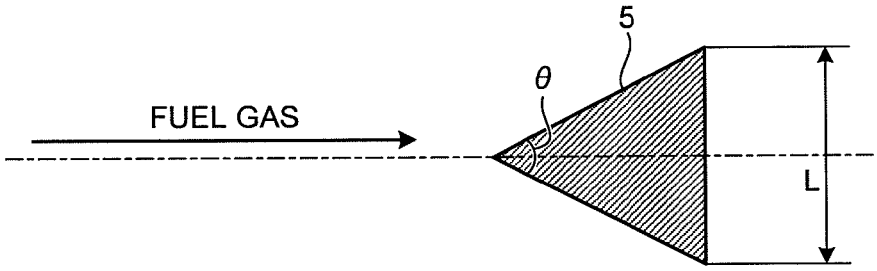
FIG. 3 is a schematic for explaining a flame holder in the combustion burner illustrated in FIG. 1.

First, when seen in cross section along a direction in which the flame holder 5 widens, the cross section passing through the central axis of the fuel nozzle 2, the flame holder 5 has a splitting shape that widens in the flow direction of fuel gas (mixed gas of pulverized coal and primary air) (see FIGS. 1 and 3). In addition, a maximum distance h from the central axis of the fuel nozzle 2 to the widened end (the downstream end of the splitting shape) of the flame holder 5 and an inside diameter r of the opening 21 of the fuel nozzle 2 satisfy $h/(r/2)<0.6$.

For example, in the present embodiment, the fuel nozzle 2 has the rectangular opening 21, and is so arranged that its height direction is aligned with the vertical direction and its width direction is aligned with the horizontal direction (see FIGS. 1 and 2). In the opening 21 of the fuel nozzle 2, the flame holder 5 is arranged. The flame holder 5 has a splitting shape that widens in the flow direction of the fuel gas, and has an elongated shape in the direction perpendicular to the widening direction. The flame holder 5 has its longitudinal direction aligned with the width direction of the fuel nozzle 2, and substantially transects the opening 21 of the fuel nozzle 2 in the width direction of the opening 21. Furthermore, the flame holder 5 is arranged on the central line of the opening 21 of the fuel nozzle 2, thereby bisecting the opening 21 of the fuel nozzle 2 in the height direction of the opening 21.

The flame holder 5 has a substantially isosceles triangular cross section and an elongated, substantially prismatic shape (see FIGS. 1 and 3). When seen in cross section along the axial direction of the fuel nozzle 2, the flame holder 5 is arranged on the central axis of the fuel nozzle 2. Specifically, the flame holder 5 has its vertex directed to the upstream side of the fuel gas and its bottom arranged in alignment with the opening 21 of the fuel nozzle 2. Accordingly, the flame holder 5 has a splitting shape that widens in the flow direction of the fuel gas. In addition, the flame holder 5 has a splitting angle (the vertex angle of the isosceles triangle) θ and a splitting width (the base length of the isosceles triangle) L set at respective predetermined sizes.

The flame holder 5 having such a splitting shape is arranged in a central area of the opening 21 of the fuel nozzle 2 (see FIGS. 1 and 2). The "central area" of the opening 21 herein means an area where, with the flame holder 5 having a splitting shape that widens in the flow direction of the fuel gas, when seen in cross section along the direction in which the flame holder 5 widens, the cross section passing through the central axis of the fuel nozzle 2, the maximum distance h from the central axis of the fuel nozzle 2 to the widened end (the downstream end of the splitting shape) of the flame holder 5 and the inside diameter r of the opening 21 of the fuel nozzle 2 satisfy $h/(r/2)<0.6$. In the present embodiment, because the flame holder 5 is arranged on the central axis of the fuel nozzle 2, the maximum distance h from the central axis of the fuel nozzle 2 to the widened end of the flame holder 5 is a half L/2 of the splitting width of the flame holder 5.

In the combustion burner 1, because the flame holder 5 has the splitting shape, the fuel gas is branched at the flame holder 5 in the opening 21 of the fuel nozzle 2 (see FIG. 1). In this configuration, the flame holder 5 is arranged in the central area of the opening 21 of the fuel nozzle 2, and the fuel gas is ignited and flame is stabilized in this central area. Thus, inner flame stabilization of the combustion flame (flame stabilization in the central area of the opening 21 of the fuel nozzle 2) is achieved.

Figure 4:
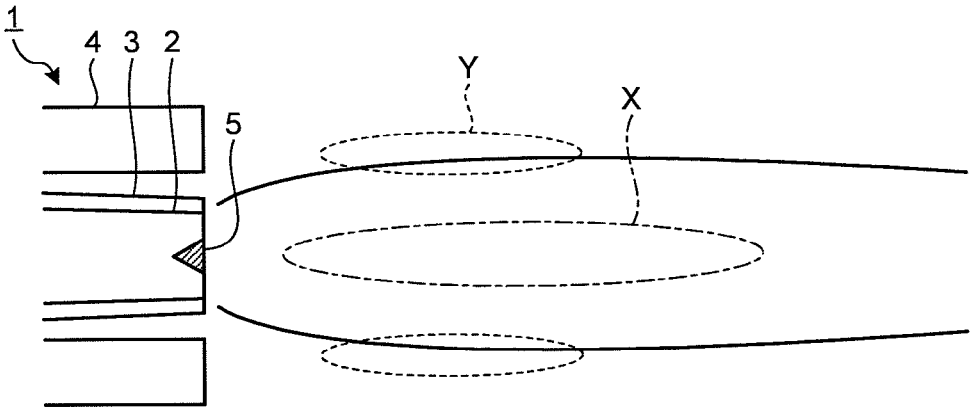
FIG. 4 is a schematic for explaining effects of the combustion burner illustrated in FIG. 1.

In this configuration, compared with configurations (not illustrated) for outer flame stabilization of combustion flame (flame stabilization in the outer periphery of the fuel nozzle or flame stabilization in an area near the inner wall surface of the opening of the fuel nozzle), an outer peripheral part Y of the combustion flame is kept at low temperature (see FIG. 4). Therefore, with the secondary air, the temperature of the outer peripheral part Y of the combustion flame in a high oxygen atmosphere can be lowered. Thus, the emission amount of NOx in the outer peripheral part Y of the combustion flame is reduced.

Figure 5:
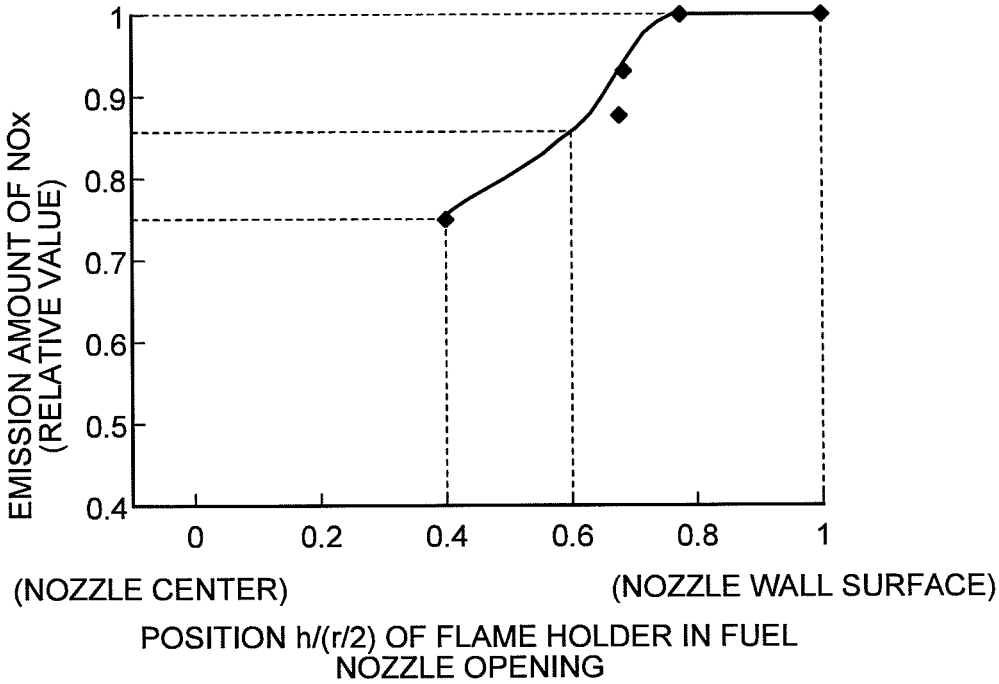
FIG. 5 is a graph of performance test results of the combustion burner illustrated in FIG. 1.

FIG. 5 is a graph of performance test results of the combustion burner illustrated in FIG. 1, depicting test results of the relationship between a position $h/(r/2)$ of the flame holder 5 in the opening 21 of the fuel nozzle 2 and the emission amount of NOx.

This performance test measured, in the combustion burner 1 illustrated in FIG. 1, the emission amount of NOx, with the distance h of the flame holder 5 varied. The inside diameter r of the fuel nozzle 2, the splitting angle θ and the splitting width L of the flame holder 5, for example, were set constant. The emission amount of NOx is represented in relative values to a configuration that stabilizes the outer flame of combustion flame (a configuration in which a flame holder is arranged on the outer periphery of a fuel nozzle, see Patent Document 1) (i.e., $h/(r/2)=1$).

As the test results represent, it can be observed that the emission amount of NOx decreases as the position of the flame holder 5 comes closer to the center of the opening 21 of the fuel nozzle 2 (see FIG. 5). Specifically, with the position of the flame holder 5 satisfying $h/(r/2)<0.6$, the emission amount of NOx decreases by equal to or more than 10%, exhibiting advantageous properties.

In the combustion burner 1, it is preferable that the ends of the flame holder 5 in the longitudinal direction and the inner wall surface of the opening 21 of the fuel nozzle 2 come into contact with each other. In the typical design, however, a minute gap d of some millimeters each is defined between the ends of the flame holder 5 and the inner wall surface of the fuel nozzle 2 in consideration of thermal expansion of members (see FIG. 2). Accordingly, in the configuration in which the ends of the flame holder 5 and the inner wall surface of the fuel nozzle 2 are arranged close to each other, the ends of the flame holder 5 are exposed to radiation from the combustion flame. As a result, flame propagation proceeds from the ends of the flame holder 5 to the inside, which is preferable.

[Splitting Angle and Splitting Width of Flame Holder]

In the combustion burner 1, to suppress the emission amount of NOx as a result of the combustion of the solid fuel, it is preferable that the splitting shape of the flame holder 5 be optimized, which will be described below.

As mentioned earlier, in the combustion burner 1, the flame holder 5 has the splitting shape to branch the fuel gas (see FIG. 3). In this configuration, it is preferable that the flame holder 5 have a splitting shape with a triangular cross section with its vertex directed to the upstream side of the flow direction of the fuel gas (see FIG. 6(*a*)). With the flame holder 5 having such a triangular cross section, branched fuel gas flows along the side surfaces of the flame holder 5 and is drawn into the base side due to differential pressure. This makes it hard for the fuel gas to diffuse outward in the radial direction of the flame holder 5, and therefore, inner flame stabilization of combustion flame is secured properly (or enhanced). Consequently, the outer peripheral part Y of the combustion flame (see FIG. 4) is kept at low temperature, whereby the emission amount of NOx due to mixing with secondary air is reduced.

Figure 6A:
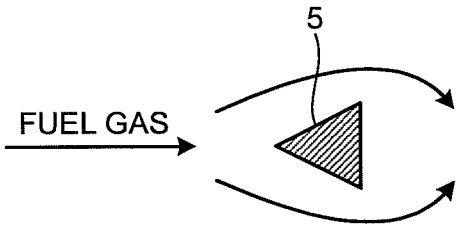
FIG. 6 is a schematic for explaining effects of the flame holder illustrated in FIG. 3.
Figure 6B:
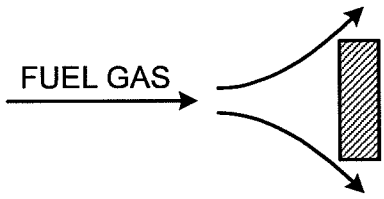

In a configuration in which a flame holder has a plate-like splitting shape (see FIG. 6(*b*)), branched fuel gas flows toward the inner wall surface of a fuel nozzle from the flame holder. This is a typical configuration in conventional combustion burners in which fuel gas is branched at the flame holder and guided along the inner wall surface of the fuel nozzle. In this configuration, an area near the inner wall surface of the fuel nozzle becomes fuel gas rich compared with a central area of the fuel nozzle, and the outer peripheral part Y of the combustion flame has higher temperature than an inner part X (see FIG. 4). As a result, in the outer peripheral part Y of the combustion flame, the emission amount of NOx due to mixing with secondary air can increase.

In the configuration described above, it is preferable that the splitting angle θ of the flame holder 5 having a triangular cross section be $\theta<90$ (degrees) (see FIG. 3). It is further preferable that the splitting angle θ of the flame holder 5 be $\theta<60$ (degrees). Under such conditions, branched fuel gas is prevented from diffusing toward wall surface sides without the fuel nozzle, whereby inner flame stabilization of combustion flame is ensured more properly.

For example, in the present embodiment, the flame holder 5 has a splitting shape with an isosceles triangular cross section, and the splitting angle θ is set to be θ<90 (degrees) (see FIG. 3). In addition, because the flame holder 5 is arranged symmetrically with respect to the flow direction of the fuel gas, each side inclined angle (θ/2) is set below 30 (degrees).

Furthermore, in the configuration described above, it is preferable that the splitting width L of the flame holder 5 with a triangular cross section and the inside diameter r of the opening 21 of the fuel nozzle 2 satisfy 0.06≤L/r, and it is more preferable that they satisfy 0.10≤L/r. Under such conditions, a ratio L/r of the splitting width L of the flame holder 5 to the inside diameter r of the fuel nozzle 2 is optimized, whereby the emission amount of NOx is reduced.

Figure 7:
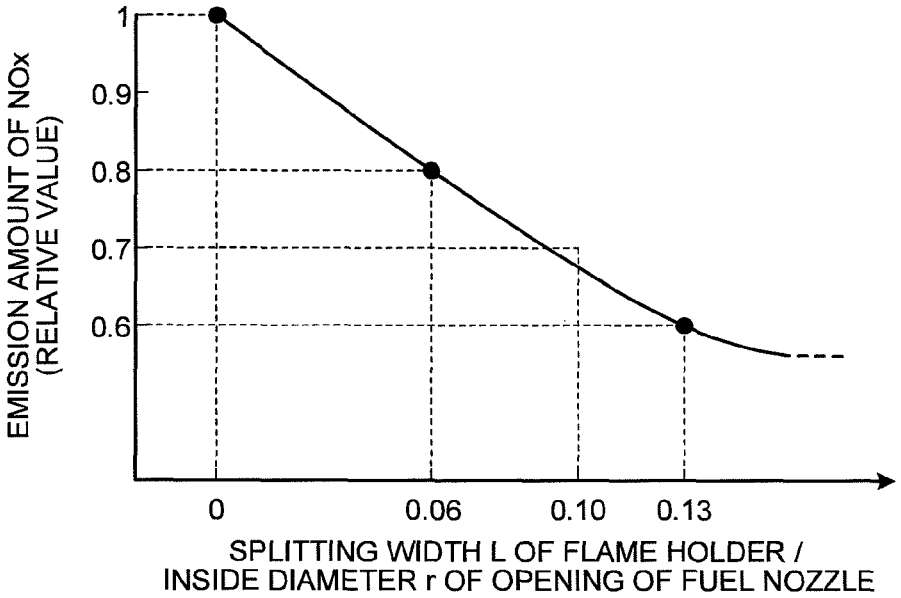
FIG. 7 is a graph of performance test results of the combustion burner.

FIG. 7 is a graph of performance test results of the combustion burner, depicting test results of the relationship between the ratio L/r of the splitting width L of the flame holder 5 to the inside diameter r of the opening 21 of the fuel nozzle 2 and the emission amount of NOx.

This performance test measured, in the combustion burner 1 illustrated in FIG. 1, the emission amount of NOx, with the splitting width L of the flame holder 5 varied. The inside diameter r of the fuel nozzle 2, the distance h and the splitting angle θ of the flame holder 5, for example, were set constant. The emission amount of NOx is represented in relative values to an example in which the splitting width L for combustion flame is L=0.

As the test results represent, it can be observed that the emission amount of NOx decreases as the splitting width L of the flame holder 5 increases. Specifically, it can be observed that the emission amount of NOx decreases by 20% with 0.06≤L/r, and the emission amount of NOx decreases by equal to or more than 30% with 0.10≤L/r. However, with 0.13<L/r, a decrease in the emission amount of NOx tends to bottom.

The upper limit of the splitting width L is defined by the relationship with the position h/(r/2) of the flame holder 5 in the opening 21 of the fuel nozzle 2. In other words, if the splitting width L becomes too large, the position of the flame holder comes closer to the inner wall surface of the fuel nozzle 2, and the inner flame stabilizing effect for combustion flame is lowered, which is not preferable (see FIG. 5). Therefore, it is preferable that the splitting width L of the flame holder 5 be optimized based on the relationship (ratio L/r) with the inside diameter r of the opening 21 of the fuel nozzle 2 and on the relationship with the position h/(r/2) of the flame holder 5.

While the flame holder 5 has a triangular cross section in the present embodiment, this is not limiting. The flame holder 5 may have a V-shaped cross section (not illustrated). This configuration also provides similar effects.

It is, however, preferable that the flame holder 5 have a triangular cross section, rather than a V-shaped cross section. For example, a V-shaped cross section can cause the flame holder to deform due to radiation heat during oil-fueled combustion (1). In addition, ash can be retained, adhered, and deposited inside the flame holder. With the flame holder 5 having a triangular cross section and the furnace made of ceramics, the adhesion of ash is alleviated.

[Straightening Structure of Fuel Nozzle]

Figure 8:
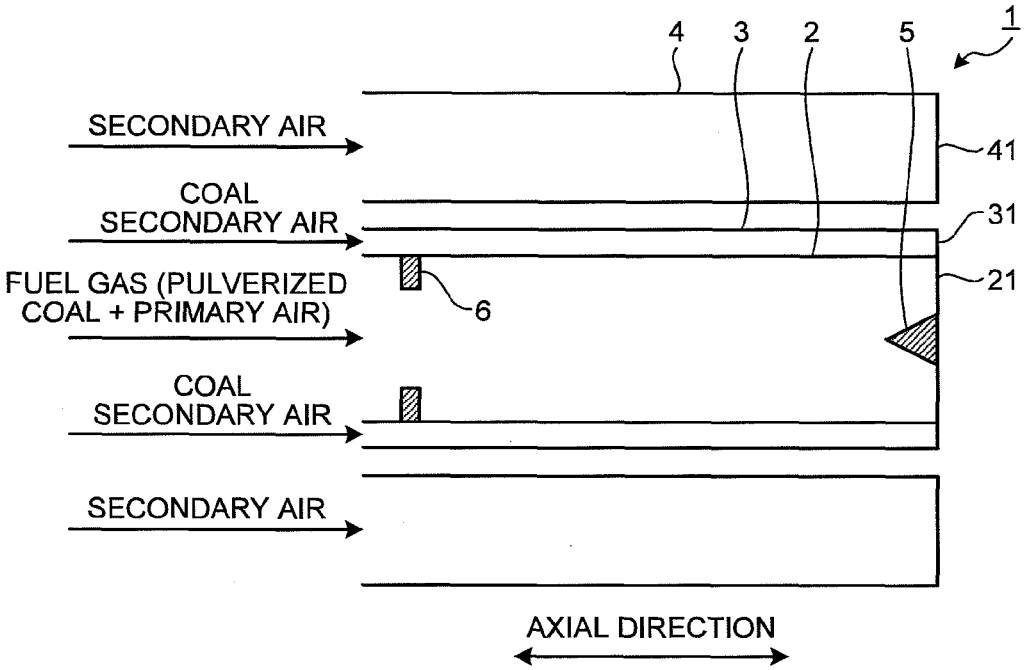
FIG. 8 is a schematic for explaining a flow straightening structure in the combustion burner illustrated in FIG. 1.
Figure 9:
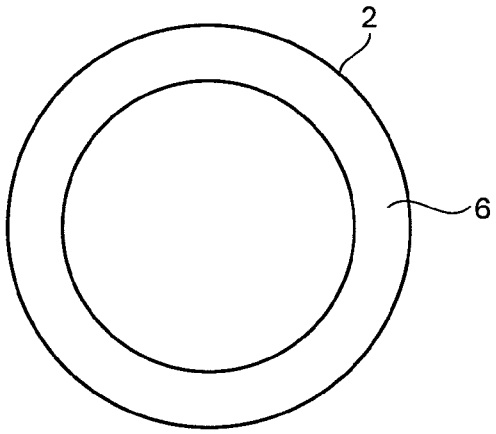
FIG. 9 is a schematic for explaining a flow straightening ring of the flow straightening structure illustrated in FIG. 8.

FIG. 8 is a schematic for explaining a flow straightening structure in the combustion burner illustrated in FIG. 1. FIG. 9 is a schematic for explaining a flow straightening ring of the flow straightening structure illustrated in FIG. 8.

In conventional combustion burners with a configuration that stabilizes the outer flame of combustion flame, fuel gas or secondary air is supplied in swirl flows or flows with steep angles. Accordingly, a recirculation area is formed in the outer periphery of a fuel nozzle, whereby outer ignition and outer flame stabilization are performed efficiently (not illustrated).

By contrast, because the combustion burner 1 employs the configuration that stabilizes the inner flame of combustion flame as described above, it is preferable that fuel gas and secondary air (main secondary air and secondary air) be supplied in straight flows (see FIG. 1). In other words, it is preferable that the fuel nozzle 2, the main secondary air nozzle 3, and the secondary air nozzle 4 have a structure to supply fuel gas or secondary air in straight flows without swirling them.

For example, it is preferable that the fuel nozzle 2, the main secondary air nozzle 3, and the secondary air nozzle 4 have a structure with no obstacles that hinder straight flows of fuel gas or secondary air in their inner gas passages (see FIG. 1). Such obstacles include, for example, swirl vanes for making swirl flows and a structure for guiding gas flows toward an area near the inner wall surface.

In this configuration, because fuel gas and secondary air are injected in straight flows to form combustion flame, in a configuration that stabilizes the inner flame of the combustion flame, gas circulation in the combustion flame is suppressed. Consequently, the outer peripheral part Y of the combustion flame (see FIG. 4) is kept at low temperature, whereby the emission amount of NOx due to mixing with secondary air is reduced.

Furthermore, in the combustion burner 1, it is preferable that the fuel nozzle 2 have a flow straightening mechanism 6 (see FIGS. 8 and 9). The flow straightening mechanism 6 is a mechanism that straightens flows of fuel gas to be supplied to the fuel nozzle 2, and has a function to cause a pressure drop in fuel gas passing through the fuel nozzle 2 and suppress flow deviation of the flue gas, for example. In this configuration, the flow straightening mechanism 6 makes straight flows of fuel gas in the fuel nozzle 2. With the flame holder 5 being arranged in the central area of the opening 21 of the fuel nozzle 2, inner flame stabilization of combustion flame is performed (see FIG. 1). Inner flame stabilization is thus secured properly, whereby the emission amount of NOx in the outer peripheral part Y of the combustion flame (see FIG. 4) is reduced.

For example, in the present embodiment, the fuel nozzle 2 has a circular tube structure on the upstream side of fuel gas (at the base of the combustion burner 1), and its cross section is gradually changed to be a rectangular cross section at the opening 21 (see FIGS. 2, 8, and 9). The flow straightening mechanism 6 of a ring orifice is arranged on an upstream part in the fuel nozzle 2. The fuel nozzle 2 has a linear passage (straight shape) of fuel gas from a position where the flow straightening mechanism 6 is disposed through the opening 21. Inside the fuel nozzle 2, in a range from the flow straightening mechanism 6 to the opening 21 (the flame holder 5), no obstacles that hinder straight flows are placed. In this manner, a structure (flow straightening structure for flue gas) is formed in which the flow straightening mechanism 6 straightens flows of fuel gas and the straight flows of the fuel gas are directly supplied to the opening 21 of the fuel nozzle 2.

It is preferable that the distance between the flow straightening mechanism 6 and the opening 21 of the fuel nozzle 2 be equal to or more than twice (2 H) a height H of the combustion burner 1, and it is more preferable that the distance be ten times (10 H) the height H. Accordingly, adverse effects of placing the flow straightening mechanism 6 to flue gas flows are reduced, whereby preferable straight flows are formed.

[First Modification in Shape of Flame Holder]

In the present embodiment, in a front view of the fuel nozzle 2, the fuel nozzle 2 has the rectangular opening 21, and the flame holder 5 is arranged to substantially transect the central area of the opening 21 of the fuel nozzle 2 (see FIG. 2). In addition, a single, elongated flame holder 5 is arranged.

Figure 10:
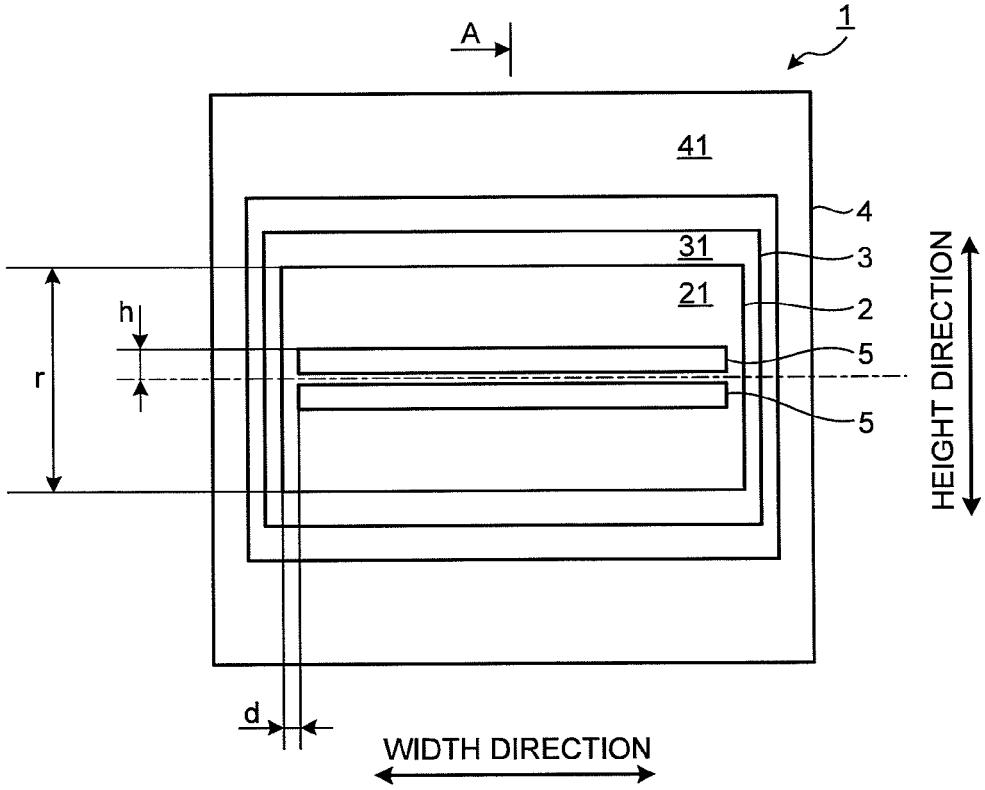
FIG. 10 is a schematic for explaining a modification of the combustion burner illustrated in FIG. 1.

This is, however, not limiting, and in the combustion burner 1, a pair of flame holders 5, 5 may be arranged in parallel in the central area of the opening 21 of the fuel nozzle 2 (see FIG. 10). In this configuration, an area sandwiched between the pair of flame holders 5, 5 is formed in the opening 21 of the fuel nozzle 2 (see FIG. 11). In the sandwiched area, air shortage occurs. As a result, a reduction atmosphere due to the air shortage is formed in the central area of the opening 21 of the fuel nozzle 2. Thus, the emission amount of NOx in the inner part X of the combustion flame (see FIG. 4) is reduced.

For example, in the present embodiment, the pair of elongated flame holders 5, 5 is arranged in parallel, with their longitudinal directions aligned with the width direction of the opening 21 of the fuel nozzle 2 (see FIG. 10). With these flame holders 5, 5 substantially transecting the opening 21 of the fuel nozzle 2, the opening 21 of the fuel nozzle 2 is divided into three areas in the height direction. When seen in cross section along the direction in which the flame holder 5 widens, the cross section passing through the central axis of the fuel nozzle 2, the flame holders 5, 5 each have a splitting shape with a triangular cross section with its widening direction aligned with the flow direction of the fuel gas (see FIG. 11). The pair of flame holders 5, 5 is so configured that the both are in the central area of the opening 21 of the fuel nozzle 2. Specifically, they are so configured that maximum distance h from the central axis of the fuel nozzle 2 to the respective widened ends of the pair of flame holders 5, 5 and the inside diameter r of the opening 21 of the fuel nozzle 2 satisfy $h/(r/2)<0.6$. In this manner, inner flame stabilization of combustion flame is performed.

Figure 11:
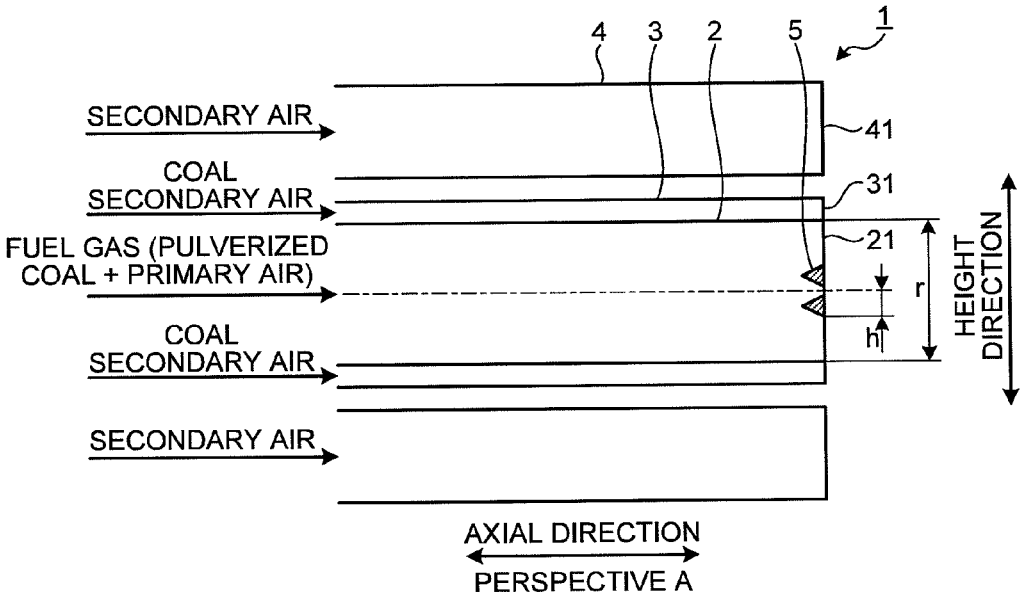
FIG. 11 is a schematic for explaining a modification of the combustion burner illustrated in FIG. 1.

In the configuration described above, the pair of flame holders 5, 5 is arranged (see FIGS. 10 and 11). This is, however, not limiting, and three or more flame holders 5 may be arranged in parallel in the central area of the opening 21 of the fuel nozzle 2 (not illustrated). In such a configuration as well, a reduction atmosphere due to the air shortage is formed in areas sandwiched between adjacent flame holders 5, 5. Thus, the emission amount of NOx in the inner part X of the combustion flame (see FIG. 4) is reduced.

[Second Modification in Shape of Flame Holder]

Figure 12:
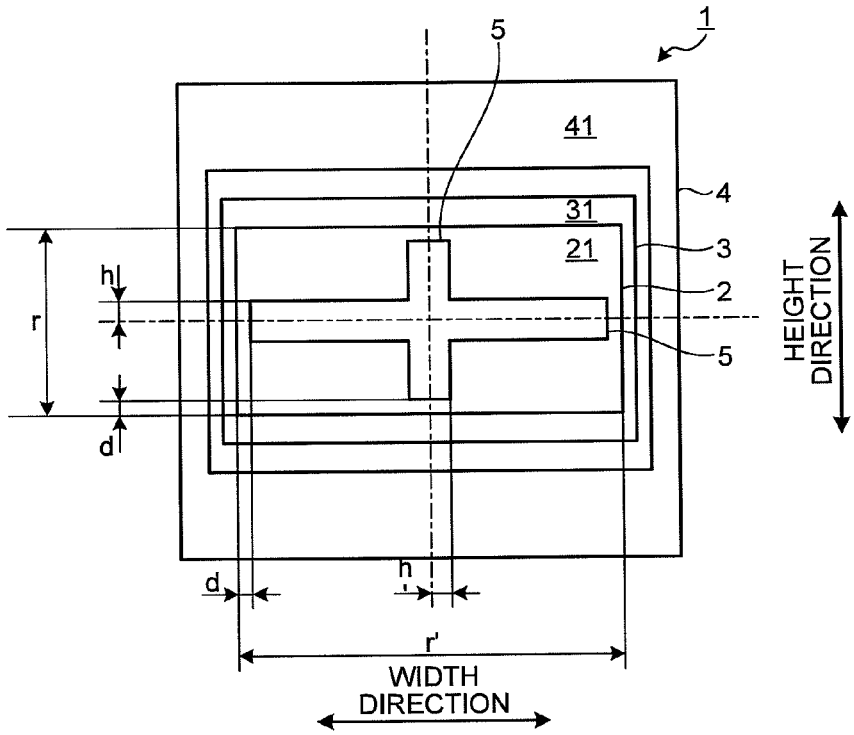
FIG. 12 is a schematic for explaining a modification of the combustion burner illustrated in FIG. 1.

Alternatively, in the combustion burner 1, the pair of flame holders 5, 5 may be arranged so that they cross each other and are connected, and their intersection is placed in the central area of the opening 21 of the fuel nozzle 2 (see FIG. 12). In this configuration, with the pair of flame holders 5, 5 crossing each other and being connected, a strong ignition surface is formed on their intersection. With this intersection placed in the central area of the opening 21 of the fuel nozzle 2, inner flame stabilization of combustion flame is performed properly. Thus, the emission amount of NOx in the inner part X of the combustion flame (see FIG. 4) is reduced.

For example, in the present embodiment, the pair of elongated flame holders 5, 5 is arranged with their longitudinal directions aligned with the width direction and the height direction of the opening 21 of the fuel nozzle 2 (see FIG. 12). These flame holders 5, 5 substantially transect the opening 21 in the width direction and the height direction, respectively. These flame holders 5, 5 are arranged in the central area of the opening 21 of the fuel nozzle 2. Accordingly, the intersection of the flame holders 5, 5 is placed in the central area of the opening 21 of the fuel nozzle 2. In addition, the flame holders 5 are so configured that the maximum distance h (h') from the central axis of the fuel nozzle 2 to the respective widened ends of the flame holders 5 and the inside diameter r (r') of the opening 21 of the fuel nozzle 2 satisfy $h/(r/2)<0.6$ ($h'/(r'/2)<0.6$). Thus, inner flame stabilization of combustion flame is achieved.

In the configuration described above, the pair of flame holders 5, 5 is arranged (see FIG. 12). This is, however, not limiting, and three or more flame holders 5 may cross each other and be connected with their intersection placed in the central area of the opening of the fuel nozzle (not illustrated). In such a configuration as well, the intersection of the flame holders 5, 5 is formed in the central area of the opening 21 of the fuel nozzle 2. Thus, inner flame stabilization of combustion flame is performed properly, and the emission amount of NOx in the inner part X of the combustion flame (see FIG. 4) is reduced.

Figure 13:
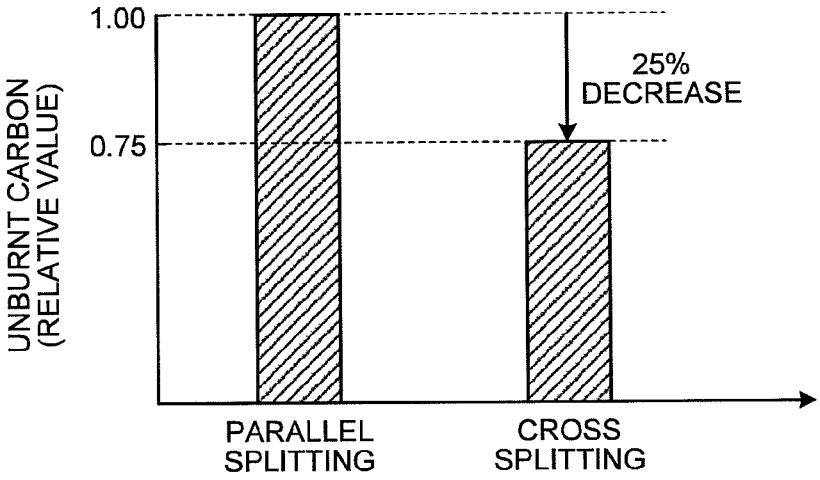
FIG. 13 is a graph of performance test results of the combustion burner.

FIG. 13 is a graph of performance test results of the combustion burner, depicting comparative test results of the combustion burner 1 illustrated in FIG. 10 and the combustion burner 1 illustrated in FIG. 12. The combustion burners 1 are common in that the both have the pair of flame holders 5, 5 arranged in the central area of the opening 21 of the fuel nozzle 2. However, the both differ from each other in that the combustion burner 1 illustrated in FIG. 10 has a structure (parallel splitting structure) in which the pair of flame holders 5, 5 is arranged in parallel, while the combustion burner 1 illustrated in FIG. 12 has a structure (cross splitting structure) in which the pair of flame holders 5, 5 is arranged in a crossing manner. Numerical values of unburnt carbon are relative values to the combustion burner 1 (1.00) illustrated in FIG. 10.

As the test results represent, it can be observed that, in the combustion burner 1 illustrated in FIG. 12, unburnt carbon decreases relatively.

[Third Modification in Shape of Flame Holder]

Figure 14:
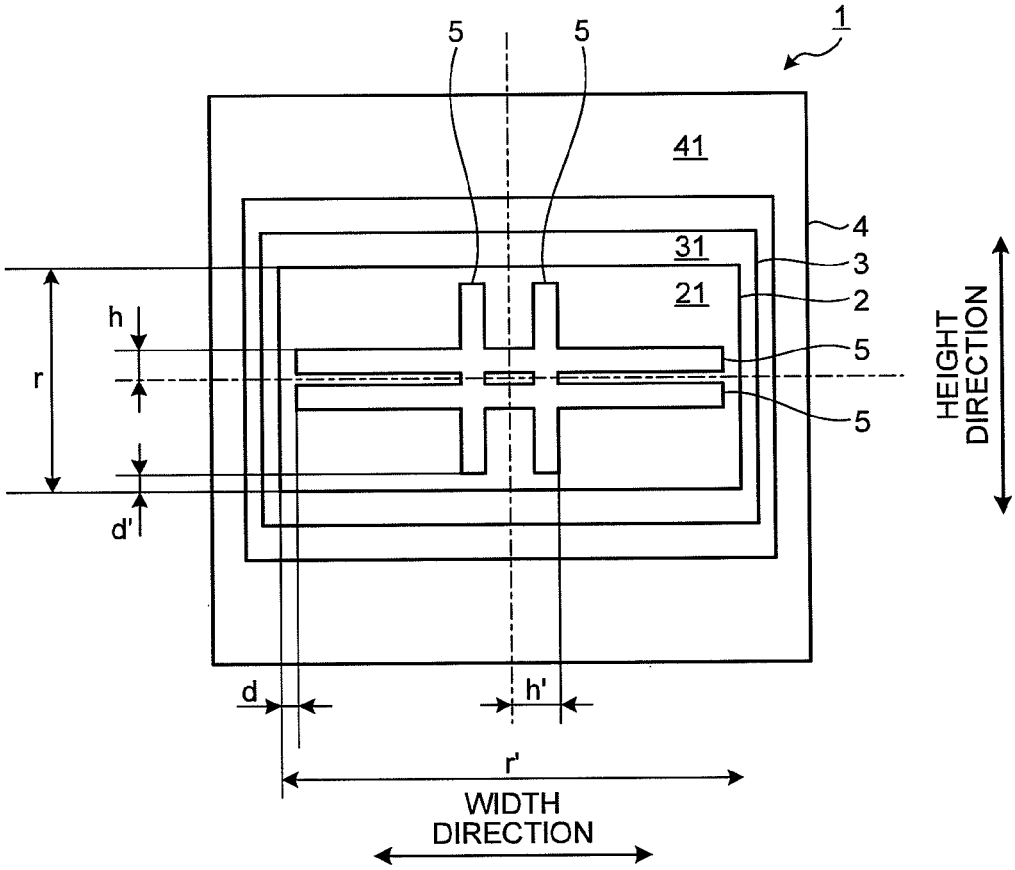
FIG. 14 is a schematic for explaining a modification of the combustion burner illustrated in FIG. 1.

Alternatively, in the combustion burner 1, a plurality of flame holders 5 may be arranged in a number sign (#) pattern, and the area surrounded by these flame holders 5 may be placed in the central area of the opening 21 of the fuel nozzle 2 (see FIG. 14). In other words, the configuration of FIG. 10 and the configuration of FIG. 12 may be combined. In this configuration, a strong ignition surface is formed on the area surrounded by the flame holders 5. With the area surrounded by the flame holders 5 placed in the central area of the opening 21 of the fuel nozzle 2, inner flame stabilization of combustion flame is performed properly. Thus, the emission amount of NOx in the inner part X of the combustion flame (see FIG. 4) is reduced.

For example, in the present embodiment, four elongated flame holders 5 are arranged in a number sign pattern, and are configured so that their longitudinal directions are aligned with the width direction or the height direction of the fuel nozzle 2 (see FIG. 14). Each flame holder 5 substantially transects the opening 21 of the fuel nozzle 2 in the width direction or the height direction. Each of the four flame holders 5 is arranged in the central area of the opening 21 of the fuel nozzle 2. Accordingly, the area surrounded by the flame holders 5 is arranged in the central area of the opening 21 of the fuel nozzle 2. In addition, the flame holders 5 are so configured that the maximum distance h from the central axis of the fuel nozzle 2 to the respective widened ends of the flame holders 5 and the inside diameter r of the opening 21 of the fuel nozzle 2 satisfy $h/(r/2)<0.6$. Thus, inner flame stabilization of combustion flame is performed properly.

In the configuration described above, it is preferable that the arrangement gaps between the flame holders 5 be set small (see FIG. 14). In this configuration, a free area in the area surrounded by the flame holders 5 is small. Consequently, a pressure drop of the area surrounded by the flame holder 5 becomes large relatively due to the splitting shape of the flame holders 5, whereby the flow velocity of flue gas of the area surrounded by the flame holder 5 in the fuel nozzle 2 decreases. Therefore, ignition of fuel gas is performed swiftly.

In the configuration described above, four flame holders 5 are arranged in a number sign pattern (see FIG. 14). This is, however, not limiting, and any number of (for example, two in the height direction and three in the width direction) of the flame holders 5 may be connected to form an area surrounded by the flame holders 5 (not illustrated). With the area surrounded by the flame holders 5 placed in the central area of the opening 21 of the fuel nozzle 2, inner flame stabilization of combustion flame is performed properly.

[Application Example with Fuel Nozzle Having Circular Opening]

In the present embodiment, in a front view of the fuel nozzle 2, the fuel nozzle 2 has the rectangular opening 21 in which the flame holders 5 are arranged (see FIGS. 2, 10, 12, and 14). This is, however, not limiting, and the fuel nozzle 2 may have a circular opening 21 in which the flame holders 5 are arranged (see FIGS. 15 and 16).

Figure 15:
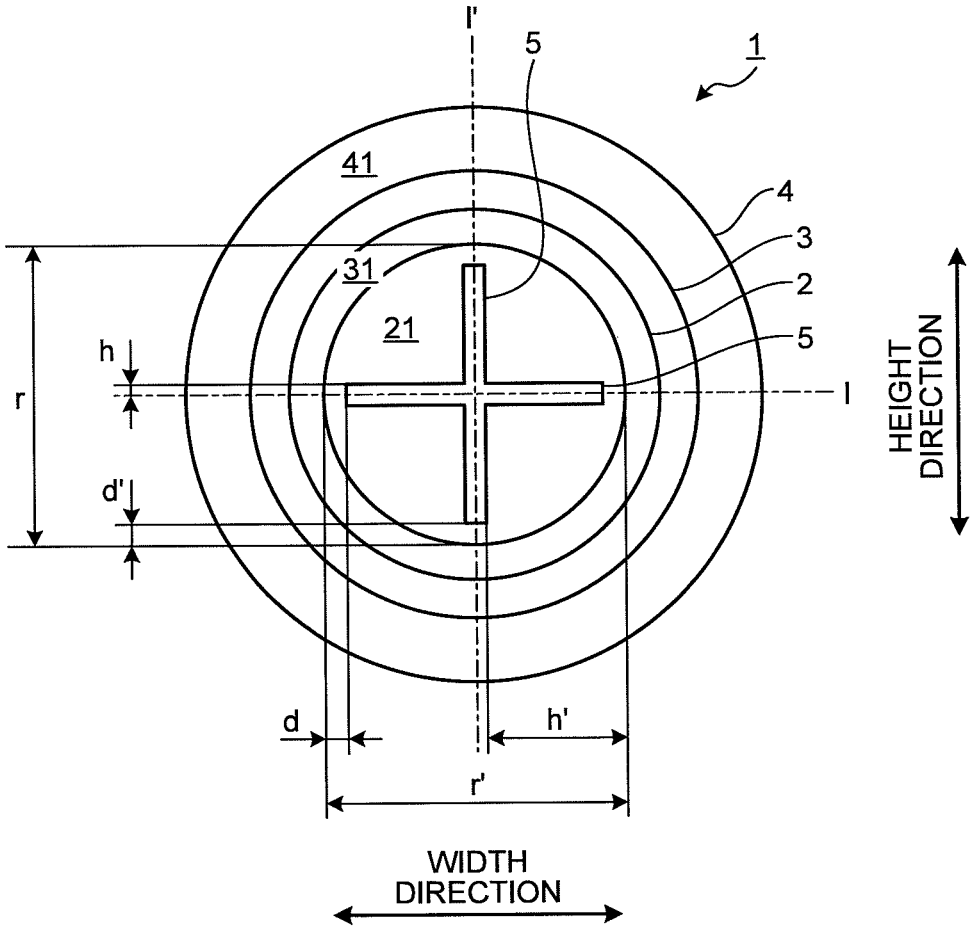
FIG. 15 is a schematic for explaining a modification of the combustion burner illustrated in FIG. 1.
Figure 16:
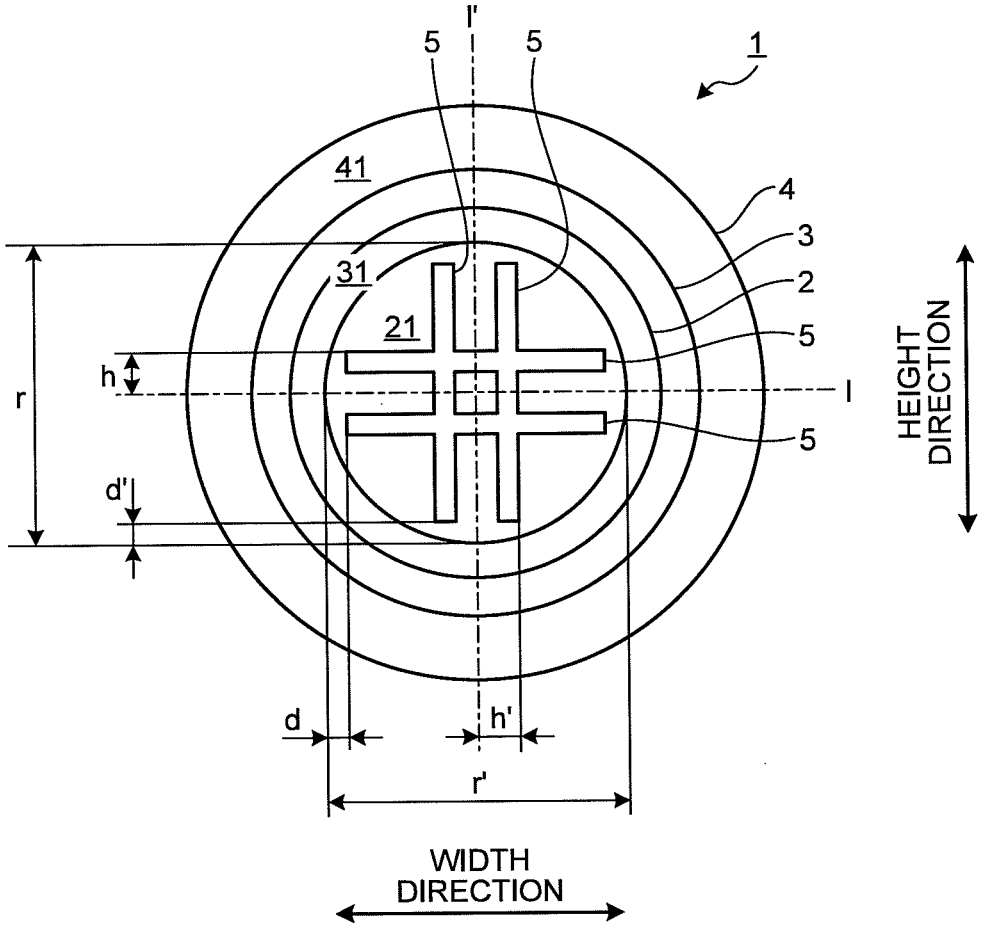
FIG. 16 is a schematic for explaining a modification of the combustion burner illustrated in FIG. 1.

For example, in the combustion burner 1 illustrated in FIG. 15, in the circular opening 21, flame holders 5 having a cross splitting structure (see FIG. 12) are arranged. In the combustion burner 1 illustrated in FIG. 16, in the circular opening 21, flame holders 5 connected in a number sign pattern (see FIG. 14) are arranged. In these configurations, with the intersection of the flame holders 5 (see FIG. 12) or the area surrounded by the flame holders 5 (see FIG. 14) arranged in the central area of the opening 21 of the fuel nozzle 2, inner flame stabilization of combustion flame is performed properly.

For example, with the circular opening 21, secondary air is supplied evenly through multiple supply of secondary air over the concentric circles. This suppresses forming of a local high-oxygen area, which is preferably.

[Damper Structure of Secondary Air Nozzle]

In general, the outer peripheral part Y of the combustion flame tends to be a local high-temperature and high-oxygen area due to supply of secondary air (see FIG. 4). It is, therefore, preferable that the supply amount of secondary air be adjusted to alleviate this high-temperature and high-oxygen state. On the other hand, when a large amount of unburnt fuel gas remains, it is preferable that this be alleviated.

Figure 17:
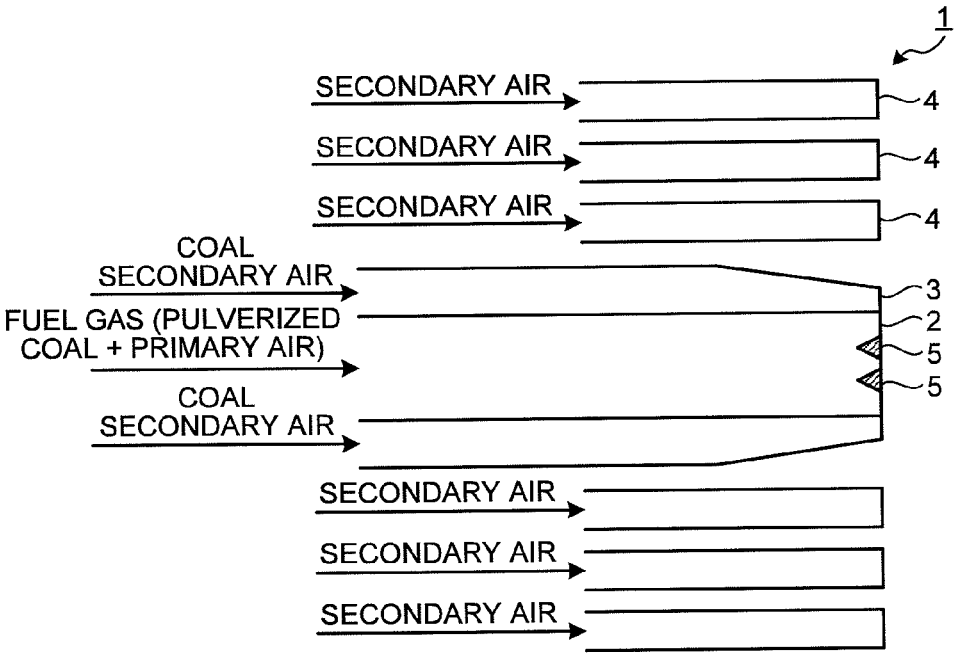
FIG. 17 is a schematic for explaining a modification of the combustion burner illustrated in FIG. 1.

Therefore, in the combustion burner 1, a plurality of (three, in this example) secondary air nozzles 4 is arranged in the outer periphery of the main secondary air nozzle 3 (see FIG. 17). Furthermore, the main secondary air nozzle 3 and each secondary air nozzle 4 have a damper structure, thereby adjusting the supply amounts of main secondary air and secondary air. In this configuration, it is preferable that each secondary air nozzle 4 be capable of adjusting the injection direction of secondary air within a range of ±30 (degrees).

In this configuration, when a secondary air nozzle 4 arranged on the outer side injects more secondary air than a secondary air nozzle 4 arranged on the inner side does, diffusion of secondary air is alleviated. Consequently, a high-temperature and high-oxygen state in the outer peripheral part Y of the combustion flame is alleviated. On the other hand, in this configuration, when a secondary air nozzle 4 arranged on the inner side injects more secondary air than a secondary air nozzle 4 arranged on the outer side does, diffusion of secondary air is promoted. Consequently, an increase in unburnt fuel gas is suppressed. In this manner, by adjusting the injection amount of secondary air from each secondary air nozzle 4, the state of combustion flame is controlled properly.

The configuration described above is useful when solid fuels with different fuel ratios are selectively used. For example, when coal with a large volatile content is used as solid fuel, by controlling to cause diffusion of secondary air in an early stage, the state of combustion flame is controlled properly.

In the configuration described above, it is preferable that all the secondary air nozzles 4 be constantly operated. In this configuration, compared with a configuration in which some secondary air nozzle(s) is(are) not operated, burnout of the secondary air nozzles caused by flame radiation from the furnace is suppressed. For example, all the secondary air nozzles 4 are constantly operated. In addition, secondary air is injected at a minimum flow velocity to an extent that a specific secondary air nozzle 4 will not be burnt down. The other secondary air nozzles 4 supply secondary air at wide ranges of flow rate and flow velocity. Accordingly, the supply of secondary air can be performed properly depending on changes in operational conditions of the boiler. For example, during low load operation of the boiler, secondary air is injected at a minimum flow velocity to an extent that a part of the secondary air nozzles 4 will not be burnt down. The supply amount of secondary air from the other secondary air nozzles 4 is adjusted as well. The flow velocity of secondary air can be thus maintained, whereby the state of combustion flame is maintained properly.

Figure 18:
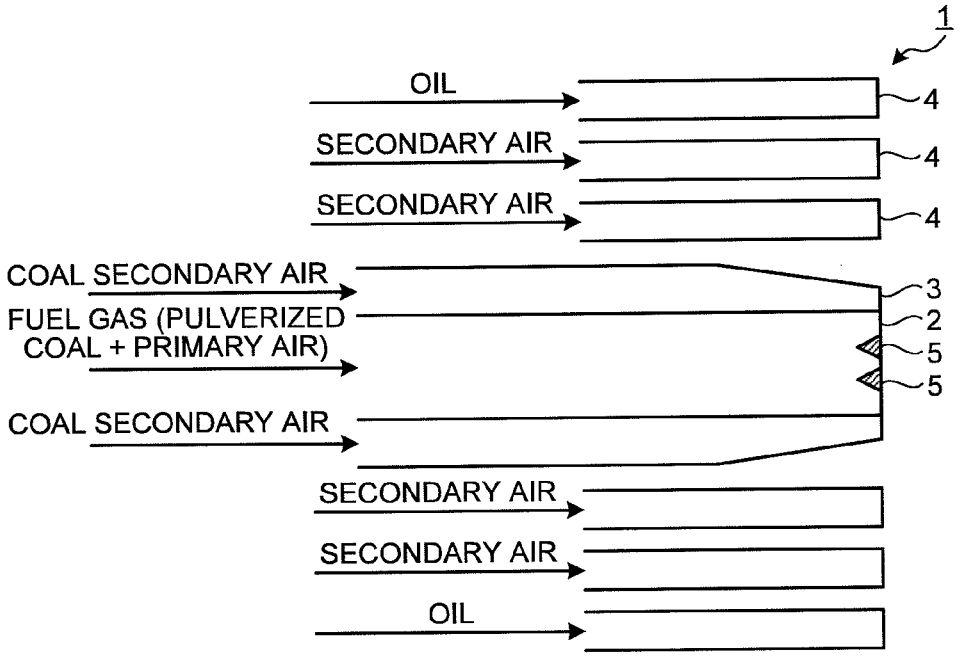
FIG. 18 is a schematic for explaining a modification of the combustion burner illustrated in FIG. 1.

In the configuration described above, a part of the secondary air nozzles 4 may also serve as an oil port (see FIG. 18). In this configuration, for example, when the combustion burner 1 is applied to the pulverized coal combustion boiler 100, a part of the secondary air nozzles 4 is used as an oil port. Through the secondary air nozzle(s) 4, oil required for start operation of the boiler is supplied. This configuration eliminates the need for additional oil ports or additional secondary air nozzles, thereby reducing the height of the boiler.

Figure 19:
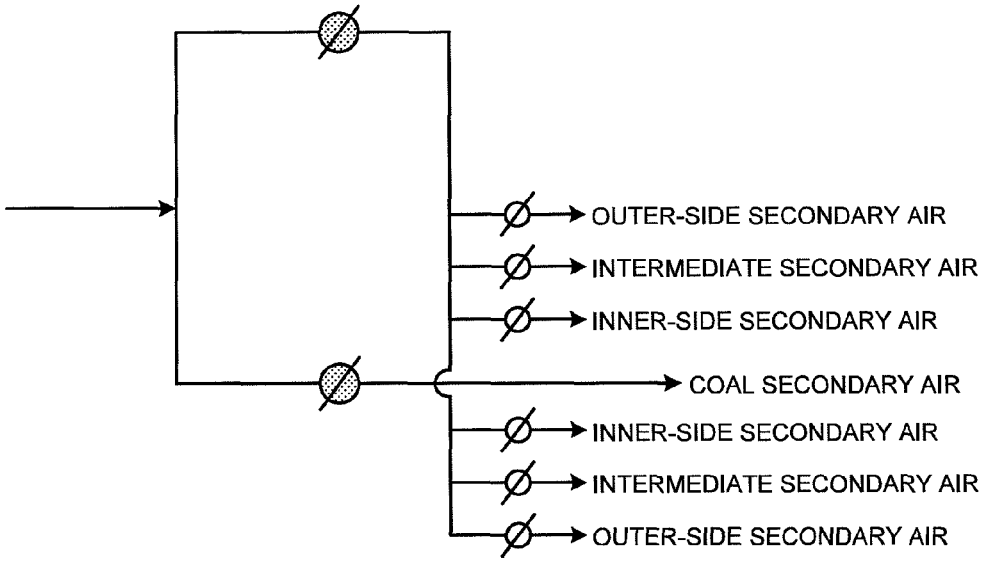
FIG. 19 is a schematic for explaining a modification of the combustion burner illustrated in FIG. 1.

In the configuration described above, it is preferable that the main secondary air supplied to the main secondary air nozzle 3 and the secondary air supplied to the secondary air nozzle 4 be supplied through different supply systems (see FIG. 19). In this configuration, even when a large number of secondary air nozzles (the main secondary air nozzle 3 and a plurality of such secondary air nozzles 4) is provided, they are readily operated and adjusted.

[Application to Wall-Fired Boiler]

It is preferable that the combustion burner 1 be applied to a wall-fired boiler (not illustrated). In this configuration, because secondary air is supplied gradually, the supply amount of air can be readily controlled. Thus, the emission amount of NOx is reduced.

[Adoption of Additional-Air Supply System]

It is preferable that the combustion burner 1 be applied to the pulverized coal combustion boiler 100 that employs the additional-air system (see FIG. 22).

In other words, this combustion burner 1 employs a configuration that stabilizes the inner flame of combustion flame (see FIG. 1). Therefore, even combustion in the inner part X of the combustion flame is promoted, whereby the temperature of the outer peripheral part Y of the combustion flame is lowered, and the emission amount of NOx from the combustion burner 1 is reduced (see FIGS. 4 and 5). Consequently, the supply ratio of air by the combustion burner 1 is increased, whereby the supply ratio of additional air is decreased. Thus, the emission amount of NOx caused by the additional air is reduced, and the emission amount of NOx of the whole boiler is reduced.

Figure 20:
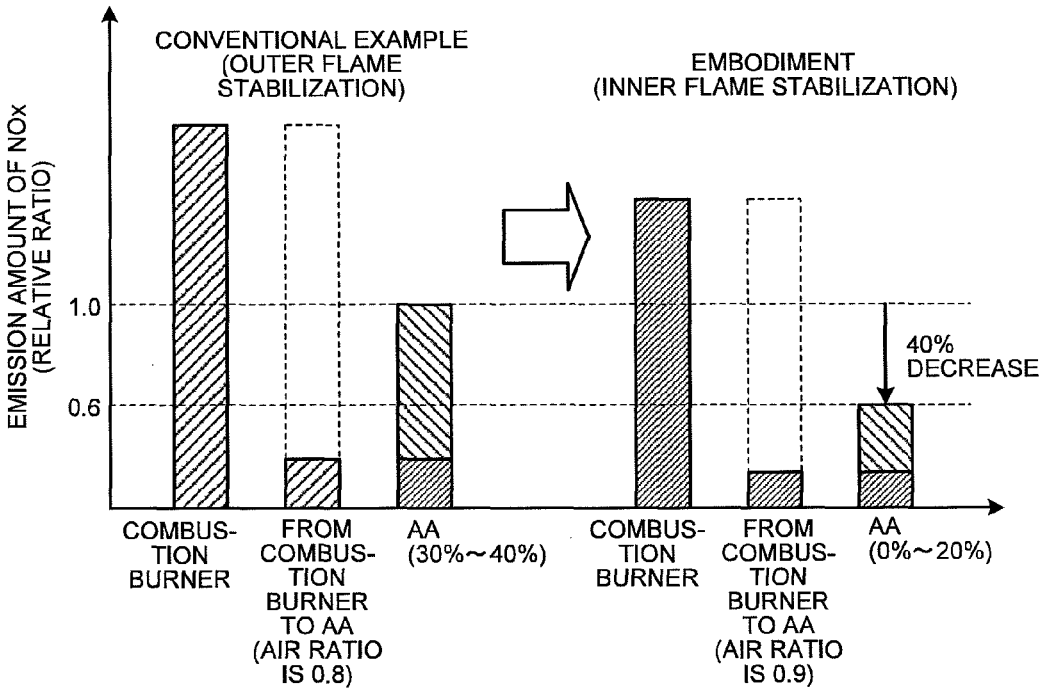
FIG. 20 is a schematic for explaining the emission amount of NOx when the combustion burner illustrated in FIG. 1 is applied to a boiler employing an additional-air system.
Figure 21:
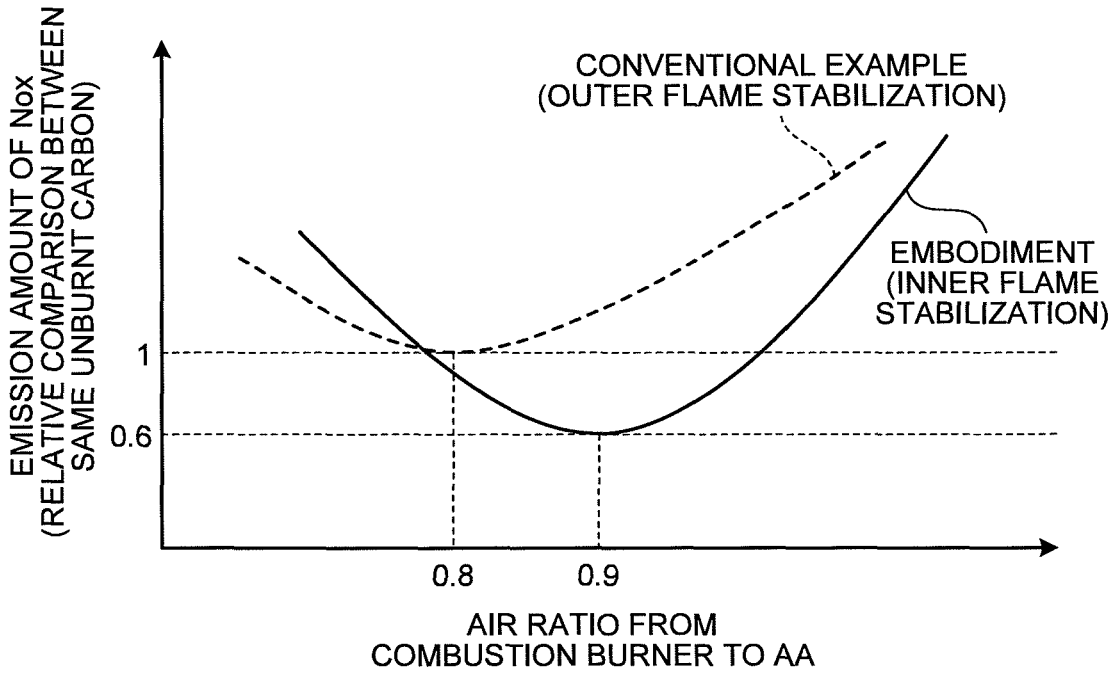
FIG. 21 is a schematic for explaining the emission amount of NOx when the combustion burner illustrated in FIG. 1 is applied to the boiler employing the additional-air system.

FIGS. 20 and 21 are schematics for explaining the emission amount of NOx when this combustion burner 1 is applied to a boiler employing an additional-air system.

Conventional combustion burners employ a configuration that stabilizes the outer flame of combustion flame (see Patent Document 1). This configuration causes an area where oxygen remains in the inner part X of the combustion flame (see FIG. 4). Therefore, to sufficiently reduce NOx, in general, the supply rate of additional air needs to be set at about 30% to 40% and the excess air ratio from a combustion burner to an additional air supply area needs to be set at about 0.8 (see the left side of FIG. 20). This in turn causes a problem of a large amount of NOx emitted in the additional air supply area.

By contrast, the combustion burner 1 employs the configuration that stabilizes the inner flame of combustion flame (see FIG. 1). In this configuration, because even combustion in the inner part X of the combustion flame (see FIG. 4) is promoted, a reduction atmosphere is formed in the inner part X of the combustion flame. Therefore, the excess air ratio from the combustion burner 1 to the additional air supply area can be increased (see FIG. 21). Accordingly, while the excess air ratio from the combustion burner 1 to the additional air supply area is increased to about 0.9, the supply rate of additional air can be decreased to about 0% to 20% (see the right side of FIG. 20). In this manner, the emission amount of NOx in the additional air supply area is reduced, and the emission amount of NOx from the entire boiler is reduced.

In the combustion burner 1, through inner flame stabilization of combustion flame, the excess air ratio of the entire boiler can be decreased to 1.0 to 1.1 (typically, the excess air ratio is about 1.15). The boiler efficiency thus increases.

[Effects]

As described above, in the combustion burner 1, when seen in cross section along the direction in which the flame holder 5 widens, the cross section passing through the central axis of the fuel nozzle 2, the flame holder 5 has a splitting shape that widens in the flow direction of the fuel gas (see FIGS. 1 and 3). The maximum distance h (h') from the central axis of the fuel nozzle 2 to the respective widened ends of the flame holders 5 and the inside diameter r (r') of the opening 21 of the fuel nozzle 2 satisfy $h/(r/2)<0.6$ (see FIGS. 1, 2, 10 to 12, and 14 to 16). Because this configuration achieves inner flame stabilization of combustion flame (flame stabilization in a central area of the opening of the fuel nozzle), the outer peripheral part Y of the combustion flame is kept at low temperature compared with configurations (not illustrated) for outer flame stabilization of the combustion flame (flame stabilization in the outer periphery of the fuel nozzle or flame stabilization in an area near the inner wall surface of the opening of the fuel nozzle) (see FIG. 4). Therefore, with the secondary air, the temperature of the outer peripheral part Y of the combustion flame in a high oxygen atmosphere can be lowered. This is advantageous in that the emission amount of NOx in the outer peripheral part Y of the combustion flame (see FIG. 4) is reduced.

In the combustion burner 1, "the central area" of the opening 21 of the fuel nozzle 2 means an area where, with the flame holder 5 having a splitting shape that widens in the flow direction of the fuel gas, when seen in cross section along the direction in which the flame holder 5 widens, the cross section passing through the central axis of the fuel nozzle 2, the maximum distance h (h') from the central axis of the fuel nozzle 2 to the widened ends (the downstream end of the splitting shape) of the flame holders 5 and the inside diameter r (r') of the opening 21 of the fuel nozzle 2 satisfy $h/(r/2)<0.6$ ($h'/(r'/2)<0.6$) (see FIGS. 1, 2, 10 to 12, and 14 to 16). The maximum distance h (h') means the maximum distance h (h') of a plurality of widened ends of the flame holders 5.

The inside diameter of the combustion nozzle 2 refers to, when the opening 21 of the fuel nozzle 2 is rectangular, an inside size r, r' in its width direction and height direction (see FIGS. 2, 10, 12, and 14); refers to, when the opening 21 of the fuel nozzle 2 is circular, its diameter r (see FIGS. 15 and 16); and refers to, when the opening 21 of the fuel nozzle 2 is elliptical, its long diameter and short diameter (not illustrated).

In the combustion burner 1, the splitting width L of the splitting shape of the flame holder 5 and the inside diameter r of the opening 21 of the fuel nozzle 2 satisfy $0.06 \leq L/r$ (see FIGS. 1 and 3). In this configuration, because the ratio L/r of the splitting width L of the flame holder 5 to the inside diameter r of the fuel nozzle 2 is optimized, inner flame stabilization is ensured properly. This is advantageous in that the emission amount of NOx in the outer peripheral part Y of the combustion flame (see FIG. 4) is reduced.

In the combustion burner 1, the fuel nozzle 2 and the secondary air nozzles 3, 4 have a structure that injects fuel gas or secondary air in straight flows (see FIGS. 1, 8, and 11). In this configuration, fuel gas and secondary air are injected in straight flows to form combustion flame, whereby in a configuration that stabilizes the inner flame of the combustion flame, the gas circulation in the combustion flame is suppressed. Consequently, the outer peripheral part of the combustion flame is kept at low temperature, whereby the emission amount of NOx due to mixing with secondary air is reduced.

In the combustion burner 1, the flame holders 5 are arranged in parallel in the central area of the opening 21 of the fuel nozzle 2 (see FIGS. 10, 11, 14, and 16). In this configuration, in an area sandwiched between adjacent flame holders 5, 5, a reduction atmosphere due to air shortage is formed. This is advantageous in that the emission amount of NOx in the inner part X of the combustion flame (see FIG. 4) is reduced.

In the combustion burner 1, the pair of flame holders 5, 5 is so arranged that they cross each other and are connected and their intersection is placed in the central area of the opening 21 of the fuel nozzle 2 (see FIGS. 12, and 14 to 16). In this configuration, with the pair of flame holders 5, 5 crossing each other and connected, strong ignition surface is formed on their intersection. With the intersection arranged in the central area of the opening 21 of the fuel nozzle 2, inner flame stabilization of combustion flame is performed properly. Thus, the emission amount of NOx in the inner part X of the combustion flame (see FIG. 4) is reduced.

In the combustion burner 1, a plurality of secondary air nozzles (the secondary air nozzle 4) is arranged, and these secondary air nozzles are capable of adjusting the supply amount of secondary air in a manner relative to each other (see FIG. 17). In this configuration, by adjusting the injection amount of secondary air from each secondary air nozzle 4, the state of combustion flame is controlled properly, which is advantageous.

In the combustion burner 1 with the configuration described above, all the secondary air nozzles (the secondary air nozzles 4) are constantly operated. This configuration is advantageous in that, compared with a configuration in which some secondary air nozzle(s) is(are) not operated, burnout of the secondary air nozzles caused by flame radiation from the furnace is suppressed.

In the combustion burner 1 with the configuration described above, a part of the secondary air nozzles 4 also serves as an oil port or a gas port (see FIG. 18). In this configuration, for example, when the combustion burner 1 is applied to the pulverized coal combustion boiler 100, through the secondary air nozzle(s) 4 also serving as an oil port or a gas port, oil required for start operation of the boiler can be supplied. This is advantageous in that this configuration eliminates the need for additional oil ports or additional secondary air nozzles and the height of the boiler can be reduced.

INDUSTRIAL APPLICABILITY

As described above, the combustion burner and the boiler including the combustion burner according to the present invention are useful in terms of reducing the emission amount of NOx.

EXPLANATIONS OF LETTERS OR NUMERALS

1 combustion burner
2 fuel nozzle
21 opening
3 main secondary air nozzle
31 opening
4 secondary air nozzle
41 opening
5 flame holder
6 flow straightening mechanism
100 boiler
110 furnace
111 combustion chamber
112 flue gas duct
120 combustion apparatus
121 combustion burner
122 pulverized coal supply system
123 air supply system
130 steam generating apparatus
131 economizer
132 reheater
133 superheater

The invention claimed is:

1. A combustion burner comprising:

a fuel nozzle that injects fuel gas prepared by mixing solid fuel and primary air;

a coal secondary air nozzle arranged on an outer side of the fuel nozzle that injects coal secondary air from an outer periphery of the fuel nozzle;

a secondary (tertiary) air nozzle arranged on an outer side of the fuel nozzle and the coal secondary air nozzle that injects secondary (tertiary) air to the outer periphery of the combustion flame; and a plurality of flame holders that are arranged in an opening of the fuel nozzle, wherein each flame holder has a structure to cross the opening of the fuel nozzle and a splitting shape that divides the fuel gas in a flow direction of the fuel gas when seen in a cross section along a direction in which the flame holder widens, such that a normal line passing through an apex located upstream of the fuel gas is in parallel to an axial direction of the fuel nozzle, wherein the fuel nozzle, the coal secondary air nozzle and the secondary (tertiary) air nozzle are respectively configured to inject the fuel gas, the coal secondary air and the secondary (tertiary) air in a straight flow which flows in parallel to the axial direction of the fuel nozzle, wherein a plurality of flame holders are arranged to extend through each other at one or more intersections, and wherein at least one intersection is placed in a central area of the opening of the fuel nozzle.

2. The combustion burner according to claim 1, wherein a splitting width L of the splitting shape of the flame holder and an inside diameter r of the opening of the fuel nozzle satisfy $0.06 \leq L/r$.

3. The combustion burner according to claim 1, wherein the fuel nozzle has a rectangular or elliptical opening, and the flame holder substantially transects a central area of the opening of the fuel nozzle.

4. The combustion burner according to claim 1, wherein the fuel nozzle has a circular opening, and the flame holder substantially transects a central area of the opening of the fuel nozzle.

5. The combustion burner according to claim 1, wherein a plurality of such secondary (tertiary) air nozzles is arranged, and the secondary (tertiary) air nozzles are capable of adjusting a supply amount of secondary air in a manner relative to each other.

6. The combustion burner according to claim 5, wherein all the secondary (tertiary) air nozzles are constantly operated.

7. The combustion burner according to claim 5, wherein a part of the secondary (tertiary) air nozzles also serves as an oil port or a gas port.

8. The combustion burner according to claim 1, wherein the plurality of the flame holders is arranged in a number sign pattern, and an area surrounded by the flame holders is placed in the central area of the opening of the fuel nozzle.

9. The combustion burner according to claim 1, wherein three of the flame holders is arranged in a crossing manner, and an area surrounded by the flame holders is placed in the central area of the opening of the fuel nozzle.

10. A boiler, comprising;

a combustion burner, the combustion burner comprising:

a fuel nozzle that injects fuel gas prepared by mixing solid fuel and primary air;

a coal secondary air nozzle arranged on an outer side of the fuel nozzle that injects coal secondary air from an outer periphery of the fuel nozzle;

a secondary (tertiary) air nozzle arranged on an outer side of the fuel nozzle and the coal secondary air nozzle that injects secondary (tertiary) air to the outer periphery of the combustion flame; and a plurality of flame holders that are arranged in an opening of the fuel nozzle, wherein each flame holder has a structure to cross the opening of the fuel nozzle and a splitting shape that divides the fuel gas in a flow direction of the fuel gas when seen in a cross section along a direction in which the flame holder widens, such that a normal line passing through an apex located upstream of the fuel gas is in parallel to an axial direction of the fuel nozzle, wherein the fuel nozzle, the coal secondary air nozzle and the secondary (tertiary) air nozzle are respectively configured to inject the fuel gas, the coal secondary air and the secondary (tertiary) air in a straight flow which flows in parallel to the axial direction of the fuel nozzle, wherein a plurality of flame holders are arranged to extend through each other at one or more intersections, and wherein at least one intersection is placed in a central area of the opening of the fuel nozzle.

11. The combustion burner according to claim 8, wherein a splitting width L of the splitting shape of the flame holder and the inside diameter r of the opening of the fuel nozzle satisfy $0.06 \leq L/r$.

12. The combustion burner according to claim 8, wherein the fuel nozzle has a rectangular or elliptical opening, and the flame holder substantially transects a central area of the opening of the fuel nozzle.

13. The combustion burner according to claim 8, wherein the fuel nozzle has a circular opening, and the flame holder substantially transects a central area of the opening of the fuel nozzle.

14. The combustion burner according to claim 8, wherein a plurality of such secondary (tertiary) air nozzles is arranged, and the secondary (tertiary) air nozzles are capable of adjusting a supply amount of secondary air in a manner relative to each other.

15. The combustion burner according to claim 9, wherein a splitting width L of the splitting shape of the flame holder and the inside diameter r of the opening of the fuel nozzle satisfy $0.06 \leq L/r$.

16. The combustion burner according to claim 9, wherein the fuel nozzle has a rectangular or elliptical opening, and the flame holder substantially transects a central area of the opening of the fuel nozzle.

17. The combustion burner according to claim 9, wherein the fuel nozzle has a circular opening, and the flame holder substantially transects a central area of the opening of the fuel nozzle.

18. The combustion burner according to claim 9, wherein a plurality of such secondary (tertiary) air nozzles is arranged, and the secondary (tertiary) air nozzles are capable of adjusting a supply amount of secondary air in a manner relative to each other.

* * * * *